US005320017A

United States Patent [19]

Lecrone

[11] Patent Number: 5,320,017

[45] Date of Patent: Jun. 14, 1994

[54] FLOATING TOP CONVEYOR HAVING ENDLESS BELT WITH DUAL INDEPENDENTLY MOVABLE TENSIONING ROLLERS

[75] Inventor: Dale S. Lecrone, Jackson, Mich.

[73] Assignee: LeMatic, Inc., Jackson, Mich.

[21] Appl. No.: 33,263

[22] Filed: Mar. 16, 1993

[51] Int. Cl.[5] ..... B26D 3/30

[52] U.S. Cl. ..... 83/871; 83/874; 83/422; 83/813

[58] Field of Search ..... 83/422, 870, 871, 874, 83/788, 813, 447, 448, 450

[56] References Cited

U.S. PATENT DOCUMENTS 3,236,128 2/1966 Holden ..... 83/874
3,470,774 10/1969 Phelps ..... 83/422 X
4,048,883 9/1977 Lecrone ..... 83/871

FOREIGN PATENT DOCUMENTS 1368553 6/1964 France ..... 83/870

*Primary Examiner*—Eugenia Jones
*Attorney, Agent, or Firm*—Flynn, Thiel, Boutell & Tanis

[57] ABSTRACT

A roll slicing machine includes an endless conveyor belt moving in a first horizontal direction and having rolls thereon, a pressure applying arrangement spaced above the conveyor which can engage the tops of the rolls, and a roll slicing knife provided vertically between the conveyor and the pressure applying arrangement. The pressure applying arrangement includes an endless belt movably supported by two spaced rollers, and a pair of rollers rotatable about horizontal axes are movably supported above the lower reach of the belt and biased downwardly into engagement with the lower reach of the belt. The rollers engage the belt at locations which are approximately aligned with each other in the direction of movement of the belt portion and are approximately adjacent each other in a direction transverse to the belt portion.

12 Claims, 2 Drawing Sheets

FLOATING TOP CONVEYOR HAVING ENDLESS BELT WITH DUAL INDEPENDENTLY MOVABLE TENSIONING ROLLERS

FIELD OF THE INVENTION

The invention relates to a band-type conveyor for slicing rolls and, more particularly, to a portion of such a conveyor which applies pressure to the tops of the rolls while they are being sliced.

BACKGROUND OF THE INVENTION

As bakery operations have become automated over the years, machines have been developed to rapidly and accurately slice rolls such as hamburger buns. One machine of this type is shown in the present inventor's U.S. Pat. No. 4,048,883, and uses a moving endless band as a knife to slice the rolls. The rolls move toward the knife on a moving conveyor, and then a pressure applying arrangement applies pressure to the top surfaces of the rolls in order to ensure that the top and bottom surfaces are positioned so that the knife will pass substantially intermediate the top and bottom surfaces, and in order to ensure that the roll does not tilt or move sideways as it is being sliced. While the pressure applying arrangement disclosed in this patent has been adequate for its intended purposes, it has not been satisfactory in all respects.

Another existing device has several moving endless belts with lower reaches which can engage the tops of the rolls, each lower reach being urged downwardly by two spring-based rollers which engage the middle of the lower reach at locations spaced in the direction of movement of the lower reach. While adequate for its intended purposes, this known device has not been entirely satisfactory. Although it works in slicing machines which use rotating disks for slicing, it has not worked well with band-type slicing machines, in part because the rolls have a tendency to shift sideways.

Accordingly, one object of the present invention is to provide an improved pressure applying device for use in a roll slicing machine, which is more reliable than known arrangements in positioning and preventing sideways movement of the rolls.

SUMMARY OF THE INVENTION

The objects and purposes of the invention, including those set forth above, are met by providing a roll slicing machine which includes a substantially horizontal endless conveyor movably driven in a first horizontal direction, a pressure applying arrangement spaced above the conveyor, and a roll slicing arrangement provided vertically between the conveyor and the pressure applying arrangement. The pressure applying arrangement includes an elongate belt portion supported for movement approximately in the first horizontal direction, first and second roller support portions provided above the belt portion and movable approximately vertically toward and away from the belt portion, first and second rollers respectively rotatably supported on the first and second roller support portions for rotational movement about respective first and second axes each extending in a second horizontal direction approximately perpendicular to the first direction, and an arrangement yieldably urging each roller support portion toward the belt portion, the rollers engaging the belt portion on a side thereof remote from the conveyor, and the rollers being approximately aligned with each other with respect to the first horizontal direction and being adjacent each other in the second horizontal direction.

BRIEF DESCRIPTION OF THE DRAWINGS

A preferred embodiment of the invention is described in detail hereinafter with reference to the accompanying drawings, in which.

DETAILED DESCRIPTION

Figure 1:
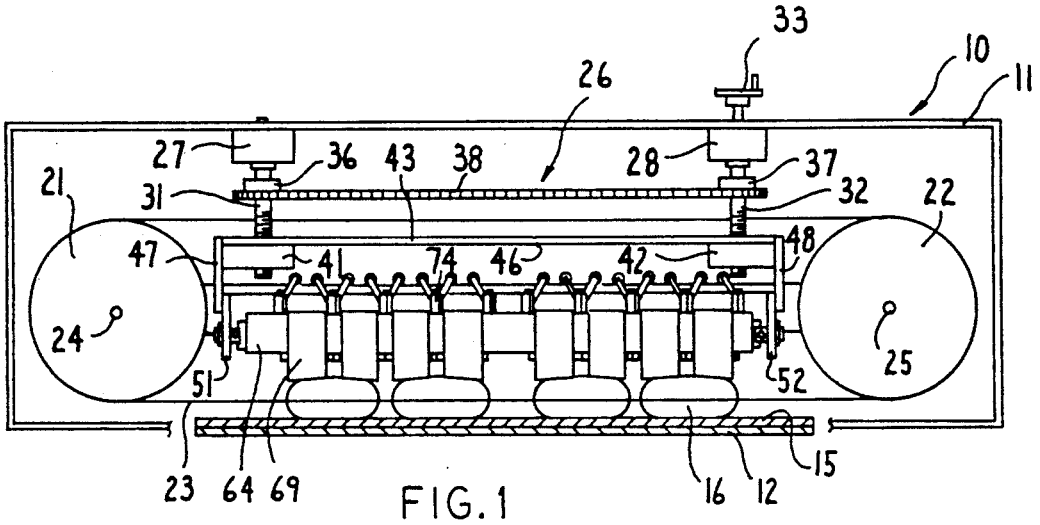
FIG. 1 is a front view of a floating top conveyor apparatus which embodies the present invention.

Referring to FIG. 1, a floating top conveyor apparatus 10 includes a stationary frame 11 which fixedly supports a horizontally extending metal support plate 12. The upper reach 15 of an endless belt is slidably supported on the top surface of the metal plate 12 for movement in a horizontal direction perpendicular to the plane of the drawing. The drive arrangement which effects movement of the endless belt 15 is conventional and not illustrated. A plurality of rolls 16 to be sliced, such as conventional hamburger buns, are supported on top of the endless belt 15.

Two spaced drums 21 and 22 are supported for rotation about respective axes 24 and 25 which extend parallel to the direction of movement of the belt 15. An endless metal band or knife 23 extends around the drums 21 and 22, and has a lower reach 23 which is spaced above the belt 15 by a distance which is approximately half the height of the roll 16, and which extends perpendicular to the direction of movement of the belt 15. At least one of the drums 21 and 22 is rotatably driven by a conventional and not-illustrated drive arrangement, to effect lengthwise movement of the lower reach 23 of the knife.

The frame 11 supports a pressure applying apparatus 26. In particular, two bearings 27 and 28 are fixedly supported on the frame 11 and each rotatably support a respective one of two vertical threaded shafts 31 and 32 so that the shafts do not move vertically as they rotate. A hand crank 33 is connected to the upper end of the shaft 32. The shafts 31 and 32 have respective gear sprockets 36 and 37 fixedly secured thereto, and an endless chain 38 extends around the sprockets so that, when the hand crank 33 is rotated, both shafts rotate in synchronism. Two nuts 41 and 42 each threadedly engage a respective shaft, and together support a U-shaped frame 43 which includes a horizontally extending bight 46 and two legs 47 and 48 extending downwardly from opposite ends of the bight 46. As the shafts 31 and 32 are synchronously rotated by the hand crank 33, the nuts 41 and 42 move upwardly or downwardly together and thus effect vertical movement of the frame 43.

Fixedly secured to the lower end of the leg 47 of the frame 43 is a vertical plate 51 which is horizontally elongated in a direction parallel to the direction of movement of the belt 15, and a similar plate 52 is fixedly secured to the lower end of the frame leg 48. The parallel plates 51 and 52 each have at the front end thereof a respective inwardly extending tab 53 or 54, and two bolts 56 and 57 each extend slidably through a hole provided through a respective one of the tabs 53 and 54. The bolt 56 has two nuts 58 and 59 provided on opposite sides of the tab 53, and the nuts 58 and 59 can be tightened against opposite sides of the tab in order to fix the axial position of the bolt 56 with respect to the tab 53. The bolt 57 has two similar nuts. The bolts 56 and 57 each have their rear ends fixedly secured to respective blocks 61 and 62 which are respectively slidably supported on the plates 51 and 52 for horizontal movement parallel to the direction of movement of the belt 15 (FIG. 1).

The blocks 61 and 62 support opposite ends of a horizontal shaft 63, which extends parallel to the direction of movement of the lower reach 23 of the knife and which rotatably supports a cylindrical roller 64. The rear ends of the plates 51 and 52 each have a hole containing a bearing, the bearings supporting respective ends of a shaft 66 which extends through the bearings parallel to the shaft 63. One end of the shaft 66 has a gear sprocket 67. A cylindrical roller 68 is supported on and keyed to the shaft 66 for rotation therewith. Eight flexible endless belts 69 extend around the rollers 64 and 68 at axially spaced locations.

By adjusting the axial position of the nuts on the bolts 56 and 57, the blocks 61 and 62 can be moved so as to move the roller 64 toward or away from the roller 68, thereby adjusting the amount of slack in the belts 69. As evident from FIG. 3, the belts are adjusted so that the lower reach of each has a degree of slack. A conventional and not-illustrated drive arrangement can effect rotation of the sprocket 67, which in turn effects rotation of shaft 66 and roller 68, thereby effecting lengthwise movement of the belts in a direction causing the lower reaches thereof to move in the direction indicated by arrow 70 (FIG. 3), which is the same direction in which the belt 15 of FIG. 1 moves.

Figure 3:
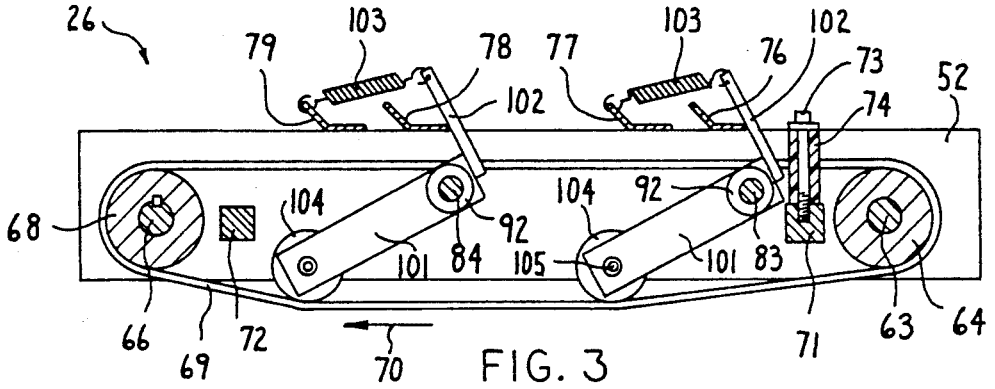
FIG. 3 is a sectional view taken along the line 3—3 in FIG. 2.

The spacing between the plates 51 and 52 is maintained by two metal bars 71 and 72 which extend between and are fixedly secured to the plates 51 and 52. The bar 71 has ten vertical bolts 73 fixed in threaded holes provided therein at axially spaced locations, and a cylindrical plastic roller 74 is rotatably supported on each of the bolts 73 so that, as shown in FIG. 3, the upper reach of each belt 69 is at approximately the middle of the vertical length of the roller 74. As evident from FIG. 2, each of the belts 69 has a respective roller 74 on each side of it, and the rollers 74 preventing the belts 69 from wandering axially along the rollers 64 and 68.

Figure 2:
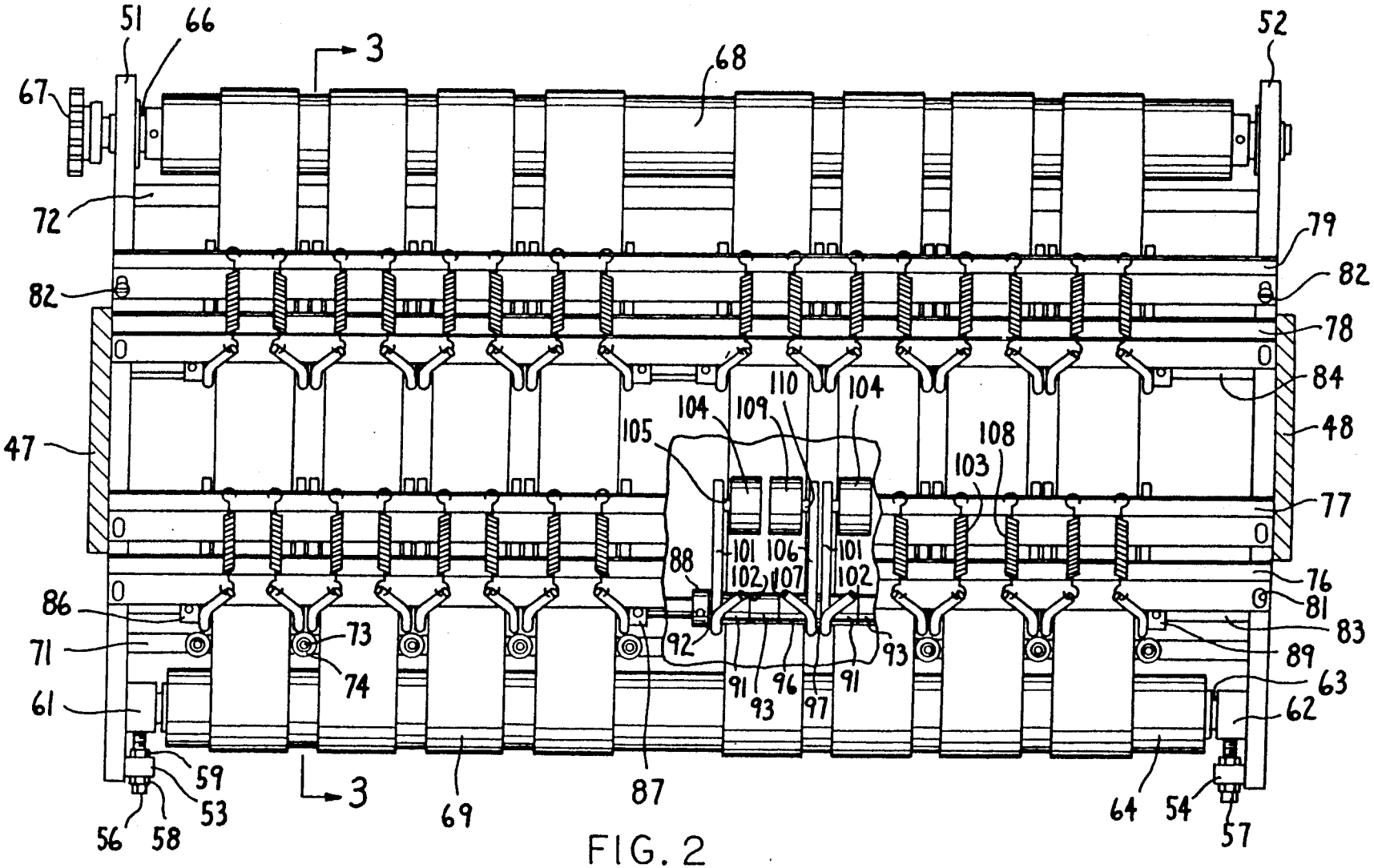
FIG. 2 is a top view of a pressure applying arrangement which is a component of the conveyor apparatus of FIG. 1, a portion of which has been cut away.

Four approximately L-shaped plates 76-79 each have their respective ends slidably supported on top of the plates 51 and 52. Each of the plates 76-79 has a horizontal leg which is parallel to and slidably engages the upper edges of the plates 51 and 52, and an inclined leg which extends upwardly and rearwardly at an obtuse angle with respect to the horizontal leg. The horizontal legs have at each end a slot extending parallel to the plates 51 and 52, for example as shown at 81. A plurality of bolts or screws 82, only two of which are shown in FIG. 2, each extend through a respective slot and engage a threaded vertical hole provided in the top edge of one of the plates 51 and 52. When the bolts for a plate are loosened the plate can be moved forwardly or rearwardly a limited amount with respect to the plates 51 and 52, and can then be secured in a selected position by tightening both bolts again.

Two cylindrical shafts 83 and 84 extend between the plates 51 and 52 parallel to the rollers 64 and 68, and have their ends fixedly secured to the plates 51 and 52. The shaft 83 is located below plate 76, and the shaft 84 is located below plate 78. As shown in FIG. 2, a pair of stop rings 86 and 87 are provided at spaced locations on the shaft 83, and are fixedly secured by setscrews to the shaft 83. Two similar stop rings 88 and 89 are also secured to the shaft 83 at spaced locations. A support sleeve 91 is rotatably supported on the shaft 83 adjacent the stop ring 86, and has at its end nearest the stop ring 86 a radially outwardly extending flange 92. A spacer sleeve 93 is provided on the shaft against the opposite end of the support sleeve 91, and the opposite end of the spacer sleeve is disposed against one end of a further support sleeve 96 having at its opposite end a radially outwardly extending flange 97. Following the set of sleeves 91, 96 and 97 are three more identical sets of sleeves, which in turn are followed by stop ring 89.

An elongate arm 101 which is a rectangular metal plate has a hole at one end through which the sleeve 91 extends, the arm 101 being adjacent the flange 92 and being fixedly secured to the sleeve 91, for example by not-illustrated welds. A bent metal rod 102 has its lower end welded to one end of the arm 101, and extends upwardly to a location above the upper edges of the plates 51 and 52, as shown in FIG. 3. An expansion spring 103 extends between the upper end of the rod 102 and the plate 77. The outer end of the arm 101 has secured thereto an axle 105 extending approximately parallel to the rollers 64 and 68, and a plastic roller 104 is rotatably supported on the axle 105 and engages the upper side of the lower reach of one of the belts 69. The support sleeve 96 supports in a similar manner an arm 106, rod 107, spring 108, pin 110 and a plastic roller 109.

As evident from FIG. 2, the rollers 104 and 109 engage two surface portions of a belt 69 which are spaced in a direction parallel to the rollers 84 and which are approximately aligned with respect to the direction of movement of the lower reach of the belt 69. By adjusting the position of the plate 77 on plates 51 and 52, the tension of all springs 103 and 108 coupled to the plate 77 can be simultaneously adjusted. Engagement of the metal rods 102 and 107 with plate 76 limits pivotal movement of the arms 101 and 106, and thus adjusting the position of the plate 76 defines the limit of pivotal movement for all of the arms 101 and 106, and thus the lowermost position of the rollers 104 and 109.

Between the rings 86 and 87, the shaft 83 supports structure similar to that provided between the rings 88 and 89. Further, the shaft 84 supports structure which is virtually identical to that supported by the shaft 83 and which is thus not described here in detail.

OPERATION

Referring to FIG. 1, as the belt 15 moves lengthwise in a direction into the paper, it carries rolls or buns 16 toward the pressure applying apparatus 26. As each bun 16 moves under the pressure applying apparatus, it preferably engages two adjacent belts 69, which apply an appropriate amount of pressure to the top of the bun in a manner which ensures that the top and bottom surfaces of the bun are positioned so that the knife blade will pass accurately intermediate them. The moving belt 15 and moving belts 69 move synchronously, and thus move each bun smoothly to and past the knife blade, so that the knife blade cleanly slices completely through each bun.

Figure 4:
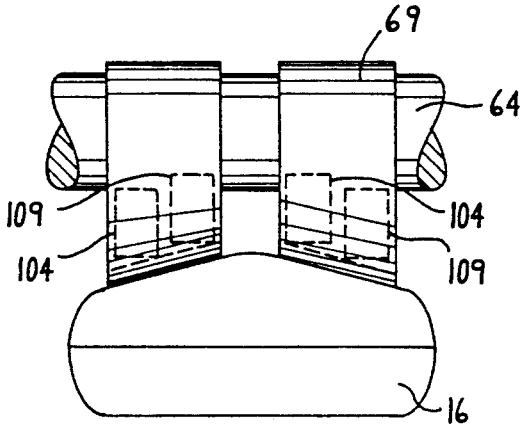
FIG. 4 is a front view in an enlarged scale of a portion of the conveyor apparatus shown in FIG. 1.
Figure 5:
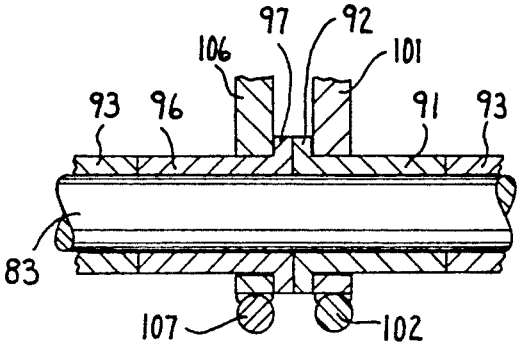
FIG. 5 is a fragmentary sectional top view of certain components of the conveyor apparatus.

Referring to FIG. 4, where the curvature of the top surface of the bun is exaggerated, it will be noted that the lower reach of each belt 69 can tilt a certain amount to accommodate the curvature of the top of the bun, each adjacent pair of rollers 104 and 109 moving independently to different vertical positions as a result of the tilt of the belt. Thus, the rollers 104 and 109 each continue to apply pressure to a respective side of the tilted lower belt reach, so that the lower reach applies uniform pressure to the surface of the bun. This arrangement has proved to be very effective in preventing the buns from shifting sideways.

Although a particular preferred embodiment of the invention has been disclosed in detail for illustrative purposes, it will be recognized that variations of the disclosed embodiment, including the rearrangement of parts, lie within the scope of the present invention.

The embodiments of the invention in which an exclusive property or privilege is claimed are defined as follows:

1. A roll slicing machine, comprising: a substantially horizontal endless conveyor movably driven in a first horizontal direction; pressure applying means spaced above said conveyor; and roll slicing means provided vertically between said conveyor and said pressure applying means; wherein said pressure applying means includes an elongate belt portion supported for movement approximately in said first horizontal direction, first and second roller support portions provided above said belt portion and movable approximately vertically toward and away from said belt portion, first and second rollers respectively rotatably supported on said first and second roller support portions for rotational movement about respective first and second axes each extending in a second horizontal direction approximately perpendicular to said first direction, and means yieldably urging each said roller support portion toward said belt portion, said rollers engaging said belt portion on a side thereof remote from said conveyor, said rollers being approximately aligned with each other with respect to said first horizontal direction and being adjacent each other in said second horizontal direction.

2. A roll slicing machine of claim 1, including third and fourth roller support portions provided above said belt portion at a location spaced in said first direction from said first and second roller support portions, said third and fourth roller support portions being movable toward and away from said belt portion, and including third and fourth rollers respectively rotatably supported on said third and fourth roller support portions for rotational movement about respective third and fourth axes each extending substantially parallel to said first and second axes, and means yieldably urging each of said third and fourth roller support portions toward said belt portion, said third and fourth rollers engaging said belt portion on a side thereof remote from said conveyor, said third and fourth rollers being approximately aligned with each other with respect to said first horizontal direction and being adjacent each other in said second horizontal direction.

3. A roll slicing machine of claim 1, wherein said first and second roller support portions respectively are elongate first and second arms which are supported for rotation about a common pivot axis extending parallel to said first and second axes and which each have rotatably supported on an opposite end thereof a respective one of said first and second rollers.

4. A roll slicing machine of claim 3, including a pair of rods which are each fixedly secured to a respective one of said first and second arms at a location near said pivot axis and which extend approximately radially outwardly away from said pivot axis, and wherein said means for yieldably urging includes resilient means cooperable with each of said rods at an end thereof remote from said pivot axis.

5. A roll slicing machine of claim 1, including a pair of belt support rollers supported for rotation about respective axes which extend in said second horizontal direction and which are spaced in said first horizontal direction, means for rotationally driving one of said belt support rollers, and an endless belt extending around said belt support rollers, said elongate belt portion being part of a lower reach of said endless belt.

6. A roll slicing machine of claim 5, including first and second guide rollers disposed on transversely opposite sides of an upper reach of said endless belt and supported for rotation about respective vertical axes, said guide rollers limiting movement of said endless belt in directions axially along said belt support rollers.

7. A roll slicing machine, comprising: a substantially horizontal endless conveyor movably driven in a first horizontal direction; pressure applying means spaced above said conveyor; and roll slicing means provided vertically between said conveyor and said pressure applying means; wherein said pressure applying means includes an elongate belt portion supported for movement approximately in said first horizontal direction, first and second roller support portions provided above said belt portion and movable approximately vertically toward and away from said belt portion, first and second rollers respectively rotatably supported on said first and second roller support portions for rotational movement about respective first and second axes each extending in a second horizontal direction approximately perpendicular to said first direction, and means yieldably urging each said roller support portion toward said belt portion, said rollers engaging said belt portion on a side thereof remote from said conveyor, said rollers being approximately aligned with each other with respect to said first horizontal direction and being adjacent each other in said second horizontal direction; wherein said first and second roller support portions respectively are elongate first and second arms which are supported for rotation about a common pivot axis extending parallel to said first and second axes and which each have rotatably supported on an opposite end thereof a respective one of said first and second rollers; including a pair of rods which are each fixedly secured to a respective one of said first and second arms at a location near said pivot axis and which extend approximately radially outwardly away from said pivot axis; wherein said means for yieldably urging includes resilient means cooperable with each of said rods at an end thereof remote from said pivot axis; including a pair of spaced, stationary side members and means movably supporting said belt portion thereon and pivotally supporting said arms thereon, a spring support plate having ends slidably supported on said side members for movement in directions parallel to said first horizontal direction, and means for releasably holding said ends of said spring plate against movement with respect to said side members; and wherein said resilient means includes two springs which each have one end coupled to said spring plate and a further end coupled to a respective one of said rods at an end thereof remote from said pivot axis.

8. A roll slicing machine of claim 7, wherein said means for releasably holding includes said spring plate having at each said end thereof a slot which extends parallel to said first horizontal direction, and a screw which extends through said slot and threadedly engages a threaded opening provided in a respective said side member.

9. A roll slicing machine of claim 7, further including a limit plate having ends slidably supported on said side members for movement parallel to said first direction, and means for releasably holding said ends of said limit plate against movement with respect to said side members, said rods each being engageable with said limit plate for limiting pivotal movement of said arms in a direction corresponding to movement of said first and second rollers toward said belt portion.

10. A roll slicing machine, comprising: a substantially horizontal endless conveyor movably driven in a first horizontal direction; pressure applying means spaced above said conveyor; and roll slicing means provided vertically between said conveyor and said pressure applying means; wherein said pressure applying means includes an elongate belt portion supported for movement approximately in said first horizontal direction, first and second roller support portions provided above said belt portion and movable approximately vertically toward and away from said belt portion, first and second rollers respectively rotatably supported on said first and second roller support portions for rotational movement about respective first and second axes each extending in a second horizontal direction approximately perpendicular to said first direction, and means yieldably urging each said roller support portion toward said belt portion, said rollers engaging said belt portion on a side thereof remote from said conveyor, said rollers being approximately aligned with each other with respect to said first horizontal direction and being adjacent each other in said second horizontal direction; wherein said first and second roller support portions respectively are elongate first and second arms which are supported for rotation about a common pivot axis extending parallel to said first and second axes and which each have rotatably supported on an opposite end thereof a respective one of said first and second rollers; including a stationary shaft extending approximately in said second horizontal direction and rotatably supporting spaced first and second sleeves and a third sleeve disposed between and having tis axial ends engaging said first and second sleeves, said first and second sleeves each having at an end thereof remote from said third sleeve a radially outwardly extending flange, said first and second sleeves each extending through an opening provided in a respective one of said first and second arms, and said first and second arms being respectively fixedly secured to said first and second sleeves at axial locations adjacent said flanges thereon.

11. A roll slicing machine, comprising: a substantially horizontal endless conveyor movably driven in a first horizontal direction; pressure applying means spaced above said conveyor; and roll slicing means provided vertically between said conveyor and said pressure applying means; wherein said pressure applying means includes an elongate belt portion supported for movement approximately in said first horizontal direction, first and second roller support arms provided above said belt portion and each supported at a first end for pivotal movement about a respective horizontal pivot axis transverse to said first horizontal direction and each extending downwardly and in said first direction from said first end thereof to a second end thereof which moves approximately vertically toward and away from said belt portion in response to pivotal movement of the arm; first and second rollers respectively rotatably supported on said first and second roller support arms at said second ends thereof for rotational movement about respective axes each extending approximately parallel to said pivot axes; and means yieldably urging each said roller support arm to pivot so that said second engaging said belt portion on a side thereof remote from said conveyor and being spaced from each other in said first horizontal direction, said slicing means being between said first and second rollers with respect to said first horizontal direction.

12. A roll slicing machine of claim 11, wherein said belt portion extends approximately rectilinearly from said first roller to said second roller for direct contact with rolls being sliced by said roll slicing means.

* * * * *

UNITED STATES PATENT AND TRADEMARK OFFICE

CERTIFICATE OF CORRECTION

PATENT NO. : 5 320 017

DATED : June 14, 1994

INVENTOR(S) : Dale S. LECRONE

It is certified that error appears in the above-identified patent and that said Letters Patent is hereby corrected as shown below:

Column 8, line 35; after "second" insert
---end thereof is urged toward said
belt portion, said rollers---.

Signed and Sealed this

Thirtieth Day of August, 1994

*Attest:*

*Attesting Officer*

Bruce Lehman

BRUCE LEHMAN

*Commissioner of Patents and Trademarks*